US008141642B2

(12) United States Patent
Olstad et al.

(10) Patent No.: US 8,141,642 B2
(45) Date of Patent: Mar. 27, 2012

(54) FILL UP AND CIRCULATION TOOL AND MUDSAVER VALVE

(75) Inventors: Delaney Michael Olstad, Clear Lake, TX (US); Russell W. Thompson, Katy, TX (US); Russell Lee Morgan, Cypress, TX (US); Jim Hollingsworth, Cypress, TX (US); Doyle Frederic Boutwell, Jr., Houston, TX (US); Michael Hayes, Houston, TX (US); Martin Liess, Seeize (DE); John D. Hooker, II, Langenhagen (DE)

(73) Assignee: Weatherford/Lamb, Inc., Houston, TX (US)

( * ) Notice: Subject to any disclaimer, the term of this patent is extended or adjusted under 35 U.S.C. 154(b) by 263 days.

(21) Appl. No.: 12/435,225

(22) Filed: May 4, 2009

(65) Prior Publication Data

US 2010/0032162 A1 Feb. 11, 2010

Related U.S. Application Data

(60) Provisional application No. 61/050,121, filed on May 2, 2008, provisional application No. 61/126,223, filed on May 2, 2008, provisional application No. 61/126,301, filed on May 2, 2008.

(51) Int. Cl.
*E21B 34/06* (2006.01)
*E21B 21/10* (2006.01)

(52) U.S. Cl. ..... 166/319; 166/321; 166/90.1

(58) Field of Classification Search ..... 166/321, 166/319, 90.1
See application file for complete search history.

(56) References Cited

U.S. PATENT DOCUMENTS

| | | | |
|---|---|---|---|
| 1,367,156 | A | 2/1921 | McAlvay et al. |
| 1,822,444 | A | 9/1931 | MacClatchie |
| 3,147,992 | A | 9/1964 | Haeber et al. |
| 3,385,370 | A | 5/1968 | Knox et al. |
| 3,698,426 | A | 10/1972 | Litchfield et al. |
| 3,888,318 | A | 6/1975 | Brown |
| 4,364,407 | A | 12/1982 | Hilliard |
| 4,377,179 | A | 3/1983 | Giebeler |
| 4,478,244 | A | 10/1984 | Garrett |
| 4,776,617 | A | 10/1988 | Sato |
| 4,779,688 | A | 10/1988 | Baugh |
| 4,955,949 | A | 9/1990 | Bailey et al. |
| 4,962,819 | A | 10/1990 | Bailey et al. |
| 4,997,042 | A | 3/1991 | Jordan et al. |
| 5,152,554 | A | 10/1992 | LaFleur et al. |
| 5,172,940 | A | 12/1992 | Usui et al. |
| 5,191,939 | A | 3/1993 | Stokley |

(Continued)

FOREIGN PATENT DOCUMENTS

| | | |
|---|---|---|
| EP | 1 260 671 | 11/2002 |

(Continued)

OTHER PUBLICATIONS

Top Drive Circulation Tool (TDCT) Brochure, Pilot Drilling Control Ltd., 2006, 5 pages.

(Continued)

*Primary Examiner* — Giovanna Wright
(74) *Attorney, Agent, or Firm* — Patterson & Sheridan, LLP

(57) ABSTRACT

A fill-up and circulation tool includes a mandrel; a packer assembly is disposed around the mandrel; and a valve assembly connected to the mandrel, wherein the valve assembly is configured to selectively control fluid flow into the tool and out of the tool.

29 Claims, 12 Drawing Sheets

U.S. PATENT DOCUMENTS

| | | | | |
|---|---|---|---|---|
| 5,282,653 | A | 2/1994 | LaFleur et al. | |
| 5,348,351 | A | 9/1994 | LaFleur et al. | |
| 5,441,310 | A | 8/1995 | Barrett et al. | |
| 5,479,988 | A | 1/1996 | Appleton | |
| 5,501,280 | A | 3/1996 | Brisco | |
| 5,509,442 | A | 4/1996 | Claycomb | |
| 5,577,566 | A | 11/1996 | Albright et al. | |
| 5,584,343 | A | 12/1996 | Coone | |
| 5,645,131 | A | 7/1997 | Trevisani | |
| 5,682,952 | A | 11/1997 | Stokley | |
| 5,735,348 | A | 4/1998 | Hawkins, III | |
| 5,918,673 | A | 7/1999 | Hawkins et al. | |
| 5,971,079 | A | 10/1999 | Mullins | |
| 5,992,520 | A | 11/1999 | Schultz et al. | |
| 6,053,191 | A | 4/2000 | Hussey | |
| 6,102,116 | A | 8/2000 | Giovanni | |
| 6,173,777 | B1 | 1/2001 | Mullins | |
| 6,279,654 | B1 | 8/2001 | Mosing et al. | |
| 6,289,911 | B1 | 9/2001 | Majkovic | |
| 6,309,002 | B1 | 10/2001 | Bouligny | |
| 6,390,190 | B2 | 5/2002 | Mullins | |
| 6,415,862 | B1 | 7/2002 | Mullins | |
| 6,431,626 | B1 | 8/2002 | Bouligny | |
| 6,460,620 | B1 | 10/2002 | LaFleur | |
| 6,571,876 | B2 * | 6/2003 | Szarka | 166/325 |
| 6,578,632 | B2 | 6/2003 | Mullins | |
| 6,595,288 | B2 | 7/2003 | Mosing et al. | |
| 6,604,578 | B2 | 8/2003 | Mullins | |
| 6,640,824 | B2 | 11/2003 | Majkovic | |
| 6,666,273 | B2 * | 12/2003 | Laurel | 166/382 |
| 6,675,889 | B1 | 1/2004 | Mullins et al. | |
| 6,715,542 | B2 | 4/2004 | Mullins | |
| 6,719,046 | B2 | 4/2004 | Mullins | |
| 6,722,425 | B2 | 4/2004 | Mullins | |
| 6,732,819 | B2 | 5/2004 | Wenzel | |
| 6,779,599 | B2 | 8/2004 | Mullins et al. | |
| 6,832,656 | B2 | 12/2004 | Fournier, Jr. et al. | |
| 6,883,605 | B2 | 4/2005 | Arceneaux et al. | |
| 7,007,753 | B2 | 3/2006 | Robichaux et al. | |
| 7,017,671 | B2 | 3/2006 | Williford | |
| 7,096,948 | B2 | 8/2006 | Mosing et al. | |
| 7,147,254 | B2 | 12/2006 | Niven et al. | |
| 7,370,698 | B2 | 5/2008 | Mosing et al. | |
| 7,490,677 | B2 | 2/2009 | Buytaert et al. | |
| 7,635,026 | B2 | 12/2009 | Mosing et al. | |
| 7,665,515 | B2 | 2/2010 | Mullins | |
| 7,690,422 | B2 | 4/2010 | Swietlik et al. | |
| 7,694,730 | B2 | 4/2010 | Angman | |
| 7,694,744 | B2 | 4/2010 | Shahin | |
| 7,866,390 | B2 | 1/2011 | Latiolais, Jr. et al. | |
| 7,874,361 | B2 | 1/2011 | Mosing et al. | |
| 7,878,237 | B2 | 2/2011 | Angman | |
| 2002/0084069 | A1 * | 7/2002 | Mosing et al. | 166/177.4 |
| 2006/0151181 | A1 * | 7/2006 | Shahin | 166/380 |
| 2009/0200038 | A1 | 8/2009 | Swietlik et al. | |
| 2009/0205827 | A1 | 8/2009 | Swietlik et al. | |
| 2009/0205836 | A1 | 8/2009 | Swietlik et al. | |
| 2009/0205837 | A1 | 8/2009 | Swietlik et al. | |
| 2009/0229837 | A1 | 9/2009 | Wiens et al. | |
| 2009/0266532 | A1 | 10/2009 | Revheim et al. | |
| 2010/0032162 | A1 | 2/2010 | Olstad et al. | |
| 2010/0206583 | A1 | 8/2010 | Swietlik et al. | |
| 2010/0206584 | A1 | 8/2010 | Clubb et al. | |
| 2011/0036586 | A1 | 2/2011 | Hart et al. | |

FOREIGN PATENT DOCUMENTS

| | | |
|---|---|---|
| EP | 1 019 614 | 7/2006 |
| WO | WO 96/07009 | 3/1996 |
| WO | WO 00/47865 | 8/2000 |
| WO | WO 2007/108703 | 9/2007 |
| WO | WO 2007/144597 | 12/2007 |
| WO | WO 2009/114625 | 9/2009 |

OTHER PUBLICATIONS

Davis Fill and Circulate Tool, Davis-Lynch, LLC, 2005, 2 pages.
FCH Modelo C, Petronov, 2005, 4 pages.
FCH Modelo L, Petronova, 2005, 4 pages.
FCH Modelo S, Petronova, 2005, 7 pages.
PCT Search Report for International Application No. PCT/US2009/042748 dated Jul. 12, 2011.

* cited by examiner

FILL UP AND CIRCULATION TOOL AND MUDSAVER VALVE

CROSS-REFERENCE TO RELATED APPLICATIONS

This application claims benefit of U.S. Provisional Patent Application Ser. No. 61/050,121, filed on May 2, 2008; U.S. Provisional Patent Application Ser. No. 61/126,223, filed on May 2, 2008; and U.S. Provisional Patent Application Ser. No. 61/126,301, filed on May 2, 2008. Each of the above referenced patent applications is incorporated herein by reference in its entirety.

BACKGROUND OF THE INVENTION

1. Field of the Invention

Embodiments of the present invention generally relate to running a casing into a wellbore. More specifically, embodiments of the present invention relate to a fill up and circulation tool for use during a casing running operation.

2. Description of the Related Art

To obtain hydrocarbons from an earth formation, a wellbore is typically drilled to a predetermined depth using a drill string having a drill bit attached to its lower end. The drill string is then removed, and thereafter a casing is lowered into the wellbore to line the wellbore. The casing may be a casing section or, in the alternative, a casing string including two or more casing sections threadedly connected to one another.

While the casing is being lowered into the wellbore during the "casing running" operation, the pressure within the wellbore is typically higher than the pressure within the bore of the casing. This higher pressure within the wellbore exerts stress on the casing as it is being lowered into the wellbore, risking damage or collapse of the casing during run-in; thus, a casing fill-up operation is performed, where the bore of the casing being run into the wellbore is filled with a fluid (often termed "mud") in an attempt to equalize the pressure inside the casing with the pressure outside the casing (the pressure within the wellbore) and thereby prevent collapse of the casing during the run-in operation. Pressurized fluid is typically input into the bore of the upper end of the casing using a fill line from the existing mud pumps at the well site.

At various times during the casing running operation, the casing may get stuck within the wellbore. To dislodge the casing from the wellbore, a circulating operation is performed by utilizing a circulation tool, where pressurized drilling fluid is circulated down the casing and out into the annulus to remove the obstructing debris. To "rig up" the circulating tool for circulating operation, the circulating tool is inserted into the bore of the casing at the upper end of the casing. A sealing member on the circulating tool is then activated to seal the circulating tool with the casing, forming a path for fluid flow through the circulating tool and out into the bore of the casing. Specifically, in a circulation operation, fluid is introduced into the circulating tool, flows through the bore of the casing and out the lower end of the casing to remove the obstructing debris, and then the fluid having the debris therein flows up the annulus to the surface of the wellbore.

After the circulation operation, the circulating tool is removed from the casing to allow another casing fill-up operation and further running of the casing into the wellbore to occur. During the casing running and fill-up operations, air must be allowed to escape through the bore of the casing to prevent over-pressurizing the bore of the casing. To permit the air being replaced by the fluid during the fill-up operation to escape from the bore of the casing, the circulating tool must be removed from the casing prior to the fill-up operation. To remove the circulating tool ("rig down"), the sealing member is de-activated, and the circulating tool is lifted from the bore of the casing. The casing may then be lowered further into the wellbore while filling the casing with fluid to prevent collapse of the casing.

Rigging up and rigging down the circulating tool, which are time-consuming procedures, must often be performed numerous times during a casing running operation. Therefore, attaching and re-attaching the circulating tool each time the casing is stuck within the wellbore during casing running is expensive and decreases the profitability of the well. Furthermore, because rig personnel perform the rigging up and rigging down of the circulating tool, which are often dangerous operations, numerous rigging up and rigging down operations decrease the safety of the well site.

Thus, there is a need for a circulating tool which is capable of performing both the fill-up and circulating operations without removal of the circulating tool from the casing. There is yet a further need for a circulating tool which allows air to escape while maintaining the circulating tool inside the casing during the duration of the casing running operation.

SUMMARY OF THE INVENTION

The present invention generally relates to a tool for use during tubular running operations. In one embodiment, a fill-up and circulation tool includes a mandrel; a packer assembly is disposed around the mandrel; and a valve assembly connected to the mandrel, wherein the valve assembly is configured to selectively control fluid flow into the tool and out of the tool. In another embodiment, the valve assembly includes a valve member biased in a first direction and a valve seat member biased in a second direction. In yet another embodiment, the valve member and the valve seat member are biased into engagement with each other. In yet another embodiment, fluid flow through the tool is blocked when the valve member and the valve seat member are engaged with each other. In yet another embodiment, fluid flow in the first direction will urge the valve seat member away from the valve member. In yet another embodiment, fluid flow in the second direction will urge the valve member away from the valve seat member.

In another embodiment, a method of flowing fluid into or out of a tubular includes providing a flow control tool having a valve assembly comprising a valve member engaged with a valve seat member; inserting the valve assembly into the tubular; supplying fluid in a first direction to urge a valve seat member away from the valve member, thereby allowing fluid to flow into the tubular; and flowing fluid from the tubular in a second direction to urge the valve member away from the valve seat member, thereby allowing fluid to flow out of the tubular. In yet another embodiment, the method further comprises providing a packer assembly on the flow control tool and sealingly engaging the packer assembly with the tubular. In yet another embodiment, the method further comprises energizing the packer assembly using fluid pressure in the tubular. In yet another embodiment, the method further comprises venting the packer assembly prior to removing the flow control tool from the tubular.

In another embodiment, a fill-up and circulation tool includes a mandrel and a vent valve disposed on the mandrel, wherein the vent valve is selectively moveable between an open position and a closed position. The fill-up and circulation tool further includes a packer assembly. Additionally, the fill-up and circulation tool includes a valve assembly disposed on the mandrel, wherein the valve assembly is configured to selectively control the flow of fluid through the fill-up and circulation tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
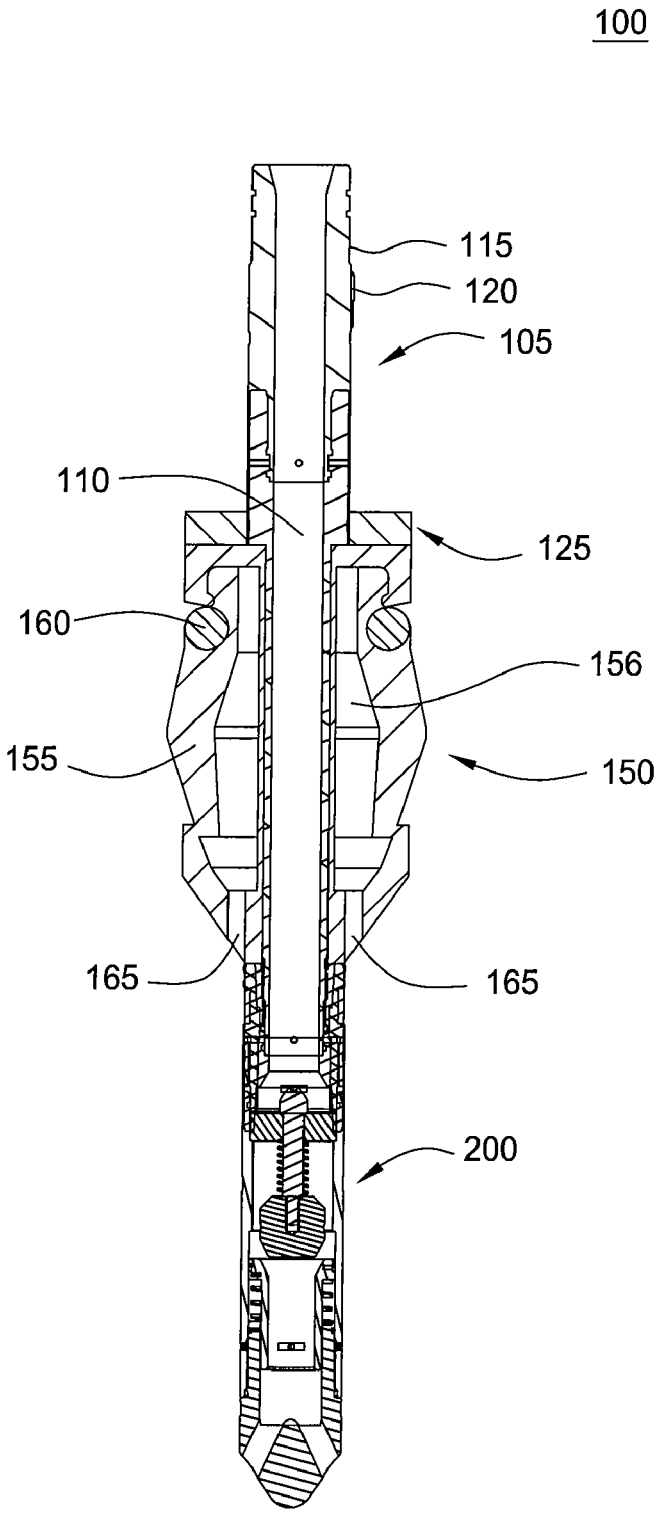
FIG. 1 is a view illustrating a fill-up and circulation tool according to one embodiment of the invention.

FIG. 1 is a view illustrating a fill-up and circulation tool 100 according to one embodiment of the invention. The tool 100 is generally used to fill a casing string with fluid and/or circulate fluid through the casing string.

As shown, the tool 100 may include a mandrel 105, a venting valve 125, a packer assembly 150, and a mudsaver valve assembly 200. The mandrel 105 extends through the venting valve 125 and the packer assembly 150, and connects to the mudsaver valve assembly 200. The mandrel 105 includes a bore 110 that is in fluid communication with the mudsaver valve assembly 200 to allow fluid to flow through the tool 100. The mandrel 105 also includes an upper portion 115 that is configured to connect the tool 100 to a wellbore tool, such as a casing clamping tool, as will be described below.

In general, the packer assembly 150 is configured to create a seal between the tool 100 and the surrounding tubular such as a casing. The packer assembly 150 includes a packer member 155 utilizes a spring 160 that is molded into the top portion of the packer member 155. The geometry of the packer member 155 is designed to form an interference fit between an inner diameter of the casing and an outer diameter of the packer member 155. In one embodiment, the packer member 155 has an upper end that is sealed against the mandrel 105 and a lower end having an opening for access to an inner void 156 in the packer member 155. In another embodiment, the outer diameter of the lower end of the packer member 155 is smaller than an inner diameter of the surrounding casing. Further, an outer diameter above the lower end is sufficiently sized to engage the inner diameter of the surrounding casing. In one embodiment, packer member 155 is a dual durometer elastomer packer. In another embodiment, a lower portion of the packer member 155 is made of a material that is harder than an upper portion of the packer member 155. During operation, the packer member 155 is forced into the surrounding casing. As the packer member 155 energizes, the spring 160 is forced out (i.e. rolls outward) and acts as a non-extrusion barrier between the outer diameter of the packer member 155 and the inner diameter of the casing. It must be noted that use of the spring 160 is optional.

Internal pressure increase caused by air or drilling fluid may be used to energize the packer member 155 into tight engagement with the inner diameter of the casing. As shown in FIG. 1, the packer assembly 150 may include a plurality of ports 165 disposed at a lower portion of the packer assembly 150. The ports 165 are configured as fluid pathways into the inner void 156 of the packer assembly 150, whereby fluid from the exterior of the packer assembly 150 may be communicated through the ports 165 into the inner void. The packer member 155 is energized when sufficient pressure supplied into the inner void. In one embodiment, flow paths (or grooves) are machined into an inner diameter of the packer member 155 to allow fluid to pass into the inner void of the packer assembly 150 to energize the packer member 155. In another embodiment, the ports may be formed in a centralizer.

Figure 2:
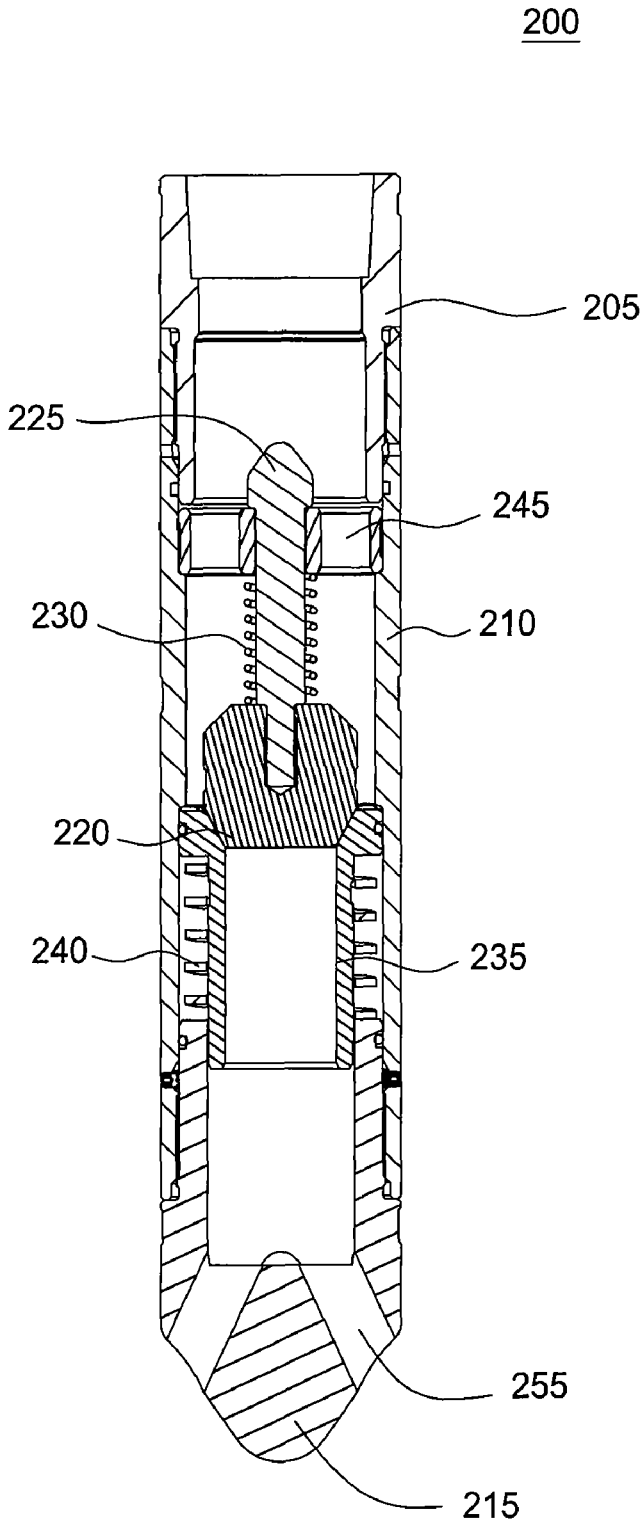
FIG. 2 is a view illustrating a mudsaver valve assembly for use with the fill-up and circulation tool, the mudsaver valve assembly is in a closed position.
Figure 3:
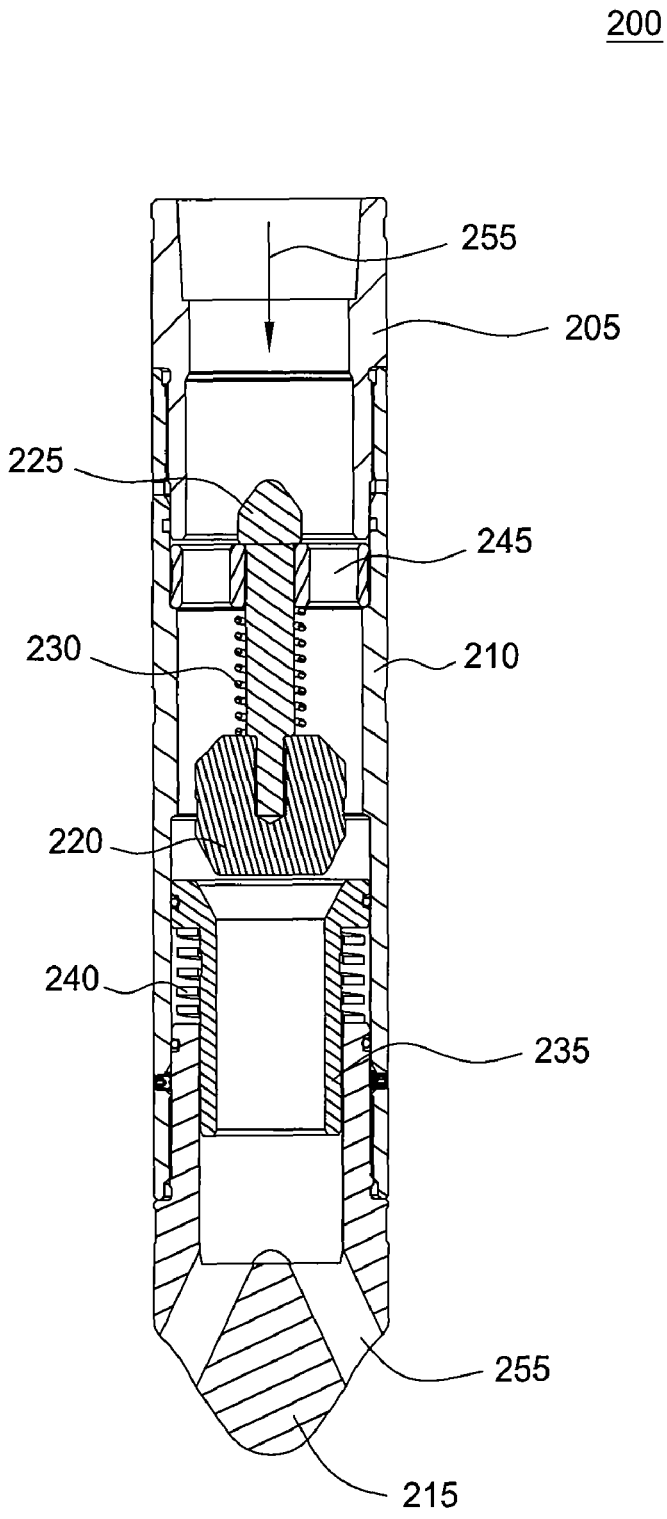
FIG. 3 is a view illustrating the mudsaver valve assembly when the fill-up and circulation tool is in a fill-up mode.
Figure 4:
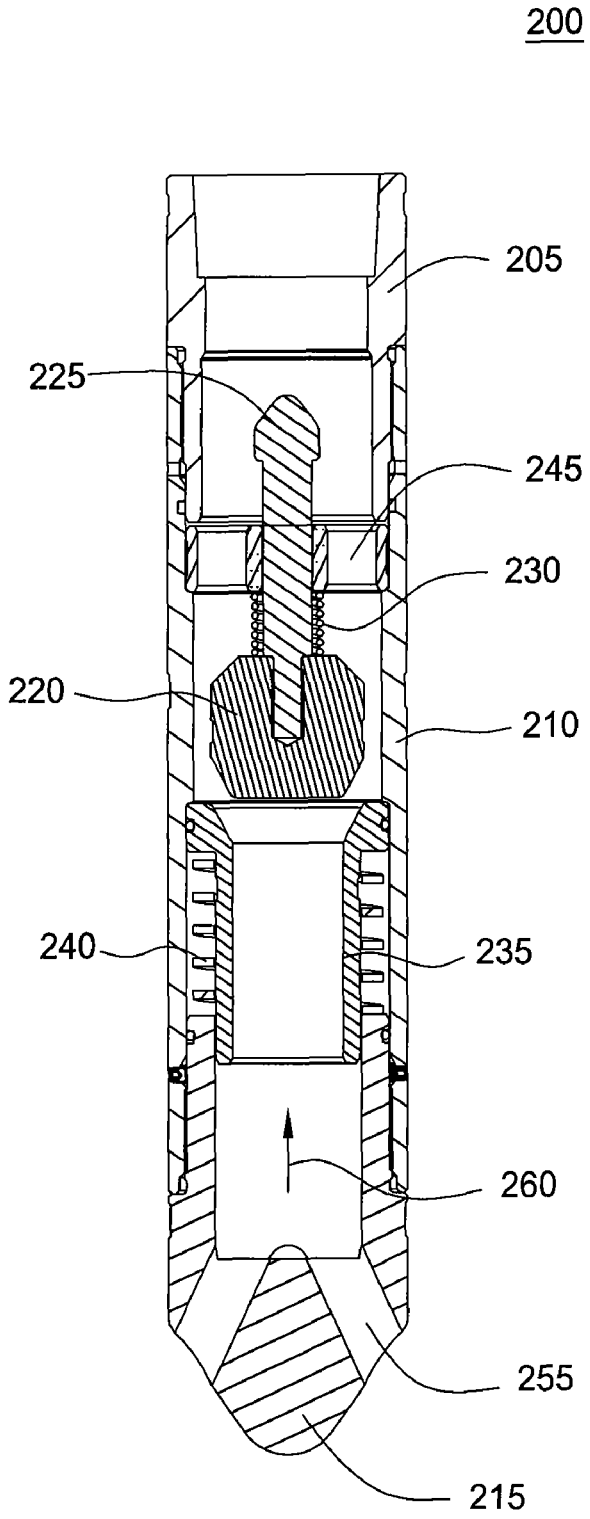
FIG. 4 is a view illustrating the mudsaver valve assembly when the fill-up and circulation tool is in a flow back mode.

FIGS. 2-4 illustrate the mudsaver valve assembly 200 in operation. FIG. 2 is a view of the mudsaver valve assembly 200 in a closed position. FIG. 3 is a view of the mudsaver valve assembly 200 in the fill-up mode. FIG. 4 is a view of the mudsaver valve assembly 200 in the flowback mode. In this embodiment, the closed position is the default position of the mudsaver valve assembly 200. Referring now to FIG. 2, the mudsaver valve assembly 200 includes a top sub 205 that is connectable to the mandrel 105 of the tool 100. The mudsaver valve assembly 200 also includes a body 210 and a nose 215. The nose 215 includes a plurality of ports 255 that are configured to act fluid pathways for fluid communication between the bore 110 of the mudsaver valve assembly 200 and the exterior of the mudsaver valve assembly 200. In one embodiment, the mudsaver valve assembly 200 includes a valve member such as a valve head 220 that is movable within the body 210. The valve head 220 is attached to one end of a valve shaft 225, while the other end of the valve shaft 225 is coupled to a ported disk 245. A first biasing member disposed between the ported disk 245 and the valve head 210 to bias valve head 210 in a direction away from the top sub 205. In one embodiment, the ported disk 245 allows fluid to pass through the mudsaver valve assembly 200. Further, the mudsaver valve assembly 200 includes a valve seat member such as a sliding sleeve 235 disposed below the valve head 220 and movable within the body 210. The sliding sleeve 235 may include seals for sealing engagement with an inner surface of the body 210. Fluid is passable through a bore of the sliding sleeve. The sliding sleeve 235 is biased away from the nose 215 via a second biasing member 240. Exemplary biasing members 230, 240 include a spring or Bellville washers. In the closed position, the valve head 220 is seated against the sliding sleeve 235 such that the bore of the sliding sleeve is closed from fluid communication.

FIG. 3 illustrates the mudsaver valve assembly 200 when the tool 100 is in the fill-up mode. In the fill-up mode or circulating mode, pumps supply fluid such as drilling fluid through the tool 100 in the direction indicated by arrow 265. The downward pressure of the drilling mud through the tool 100 may cause the sliding sleeve 235 to move within the body 210. When sufficient pressure exists to overcome the biasing force of the second biasing member 240, the sliding sleeve 235 is urged away from the valve head 220. The movement of the sliding sleeve 235 causes the sliding sleeve 235 to disengage with the valve head 220, thereby opening a fluid path through the mudsaver valve assembly 200. Subsequently, the fluid travels through the center of the sliding sleeve 235 and out through the ports 255 in the nose 215, thus filling up the casing string with drilling fluid. When the supply of fluid ceases, the second biasing member 240 forces the sliding sleeve 235 back into engagement with the valve head 220, thereby returning to the closed position as shown in FIG. 2.

FIG. 4 illustrates the mudsaver valve assembly 200 when the tool 100 is in the flow back mode. Generally, when the casing string is lowered into the wellbore, which may also be referred to as "slacked off", fluid such as mud that is already in the casing string may flow back upward as the fluid is displaced by the casing string. The mud will flow up through the ports 255 in the nose 215 and continue up through the sliding sleeve 235 as indicated by arrow 260. The upward pressure of the mud may force the valve head 220 and the shaft 225 to move in the body 210, when the upward pressure is sufficient to overcome the first biasing member 230. The movement of the valve head 220 and the shaft 225 causes the valve head 220 to disengage from the sliding sleeve 235 and open a fluid path through the mudsaver valve assembly 200. As shown, the first biasing member 230 has been compressed by the valve head 220. Subsequently, the mud is free to travel past the valve head 220, through the ported disk 245, and up through the bore 110 of the tool 100. The movement of the mud continues until the mud in the casing string reaches a point of equilibrium or the driller is finished lowering the casing string into the well. At this point, the first biasing member 230 returns the valve head 220 into engagement with the sliding sleeve 235, thereby returning to the closed position as shown in FIG. 2.

Figure 5:
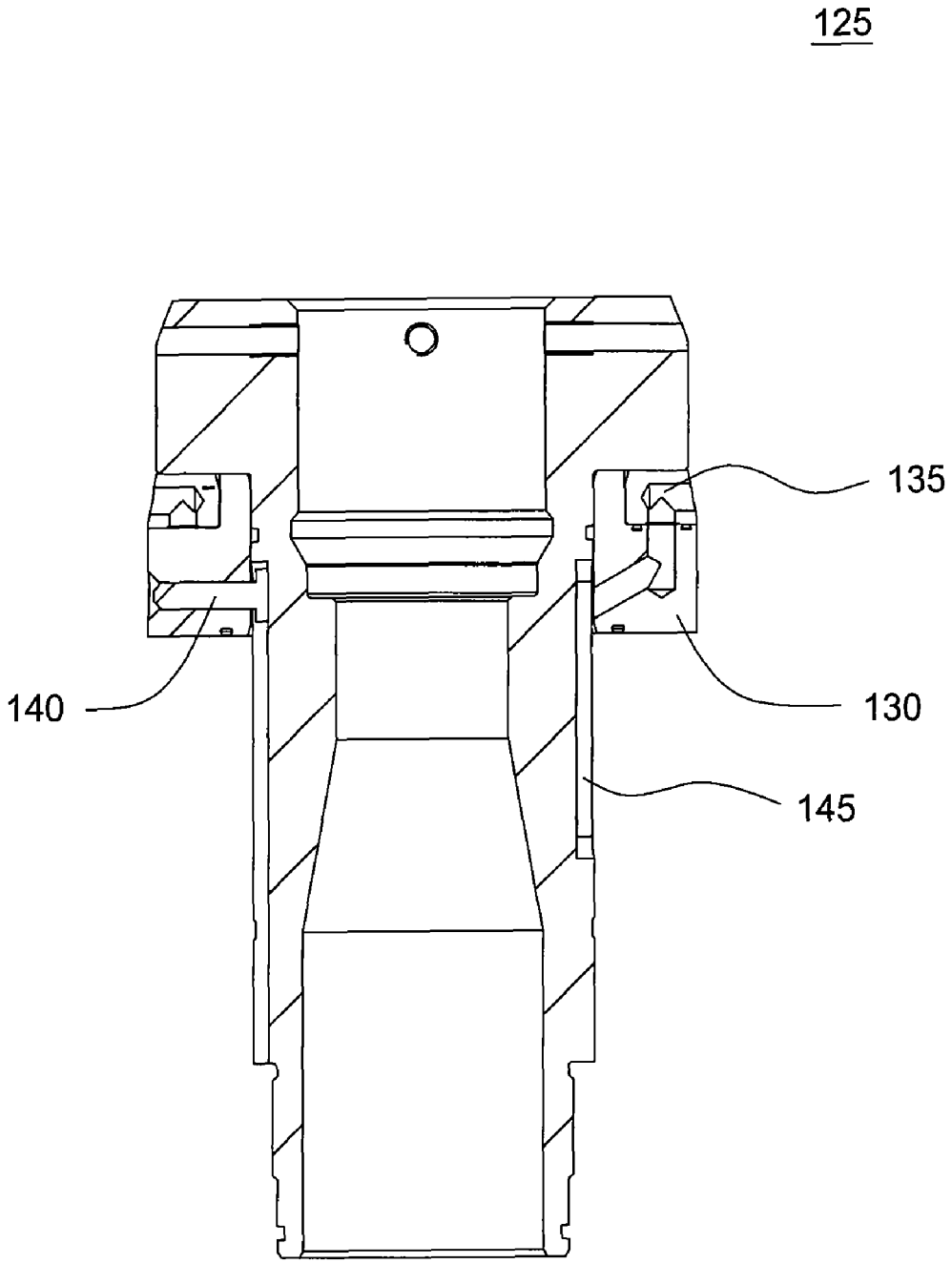
FIG. 5 is a view illustrating a venting valve for use with the fill-up and circulation tool.

In one embodiment, the tool 100 may optionally include a venting valve 125. Generally, the venting valve 125 may be used to relieve the tool 100 of downhole pressure so that drilling fluid will not spray out when the tool 100 is removed from the casing. As shown in FIG. 5, the venting valve 125 may include a lower ring 130 and an upper ring 135 disposed around the mandrel 105. The lower ring 130 of the venting valve 125 is held fixed to the top sub/internal mandrel 105 using a valve pin 140. The upper ring 135 is rotatable relative to the lower ring 130. The venting valve 125 is selectively movable between an open position and a closed position. In the open position, the upper ring 135 is rotated to align holes in the upper ring 135 with holes in the lower ring 130, thereby allowing trapped pressure from below the packer assembly 150 to vent. In the closed position, the upper ring 135 is rotated to misalign its holes with the holes in the lower ring 130, thus preventing trapped pressure to vent from the venting valve 125. The venting valve 125 further includes appropriate seals to seal around the holes in the upper ring 135 and the lower ring 130. In one embodiment, venting valve 125 may optionally include slots 145 machined in the top sub 205 to allow fluid communication through the venting valve 125.

Figure 6:
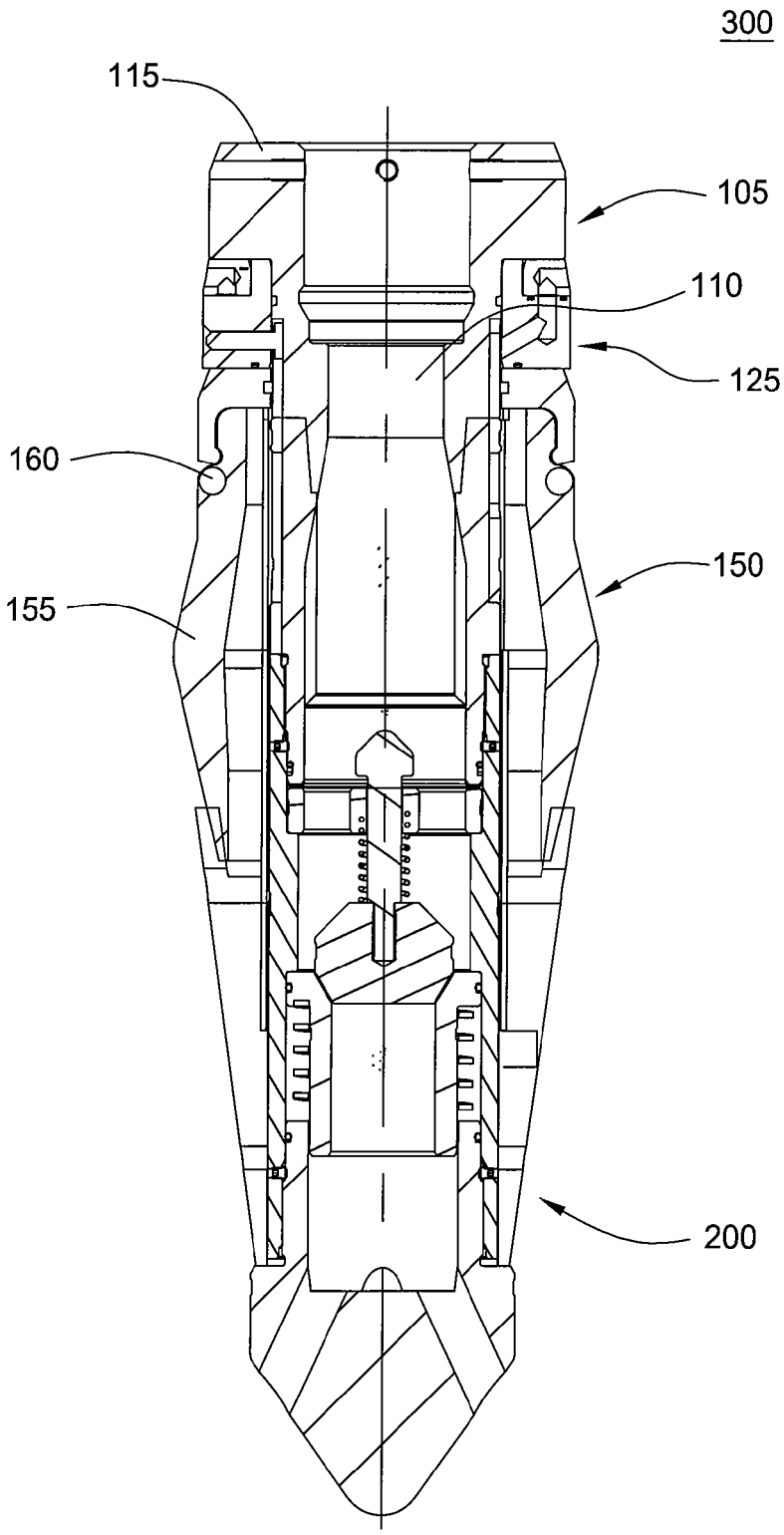
FIG. 6 is a view illustrating a fill-up and circulation tool according to another embodiment of the invention.

FIG. 6 is a view illustrating a fill-up and circulation tool 300 according to one embodiment of the invention. For convenience, the components in FIG. 6 that are similar to the components in FIG. 1 are labeled with the same reference indicator. Similar to the embodiment in FIG. 1, the tool 300 may be used to fill a casing string with fluid and/or circulate fluid through the casing string. As illustrated in FIG. 6, one difference between the tool 300 and the tool 100 is that the packer assembly 150 in the tool 300 is disposed substantially adjacent the mudsaver valve assembly 200. In this respect, the overall length of the tool 300 is reduced.

Figure 7:
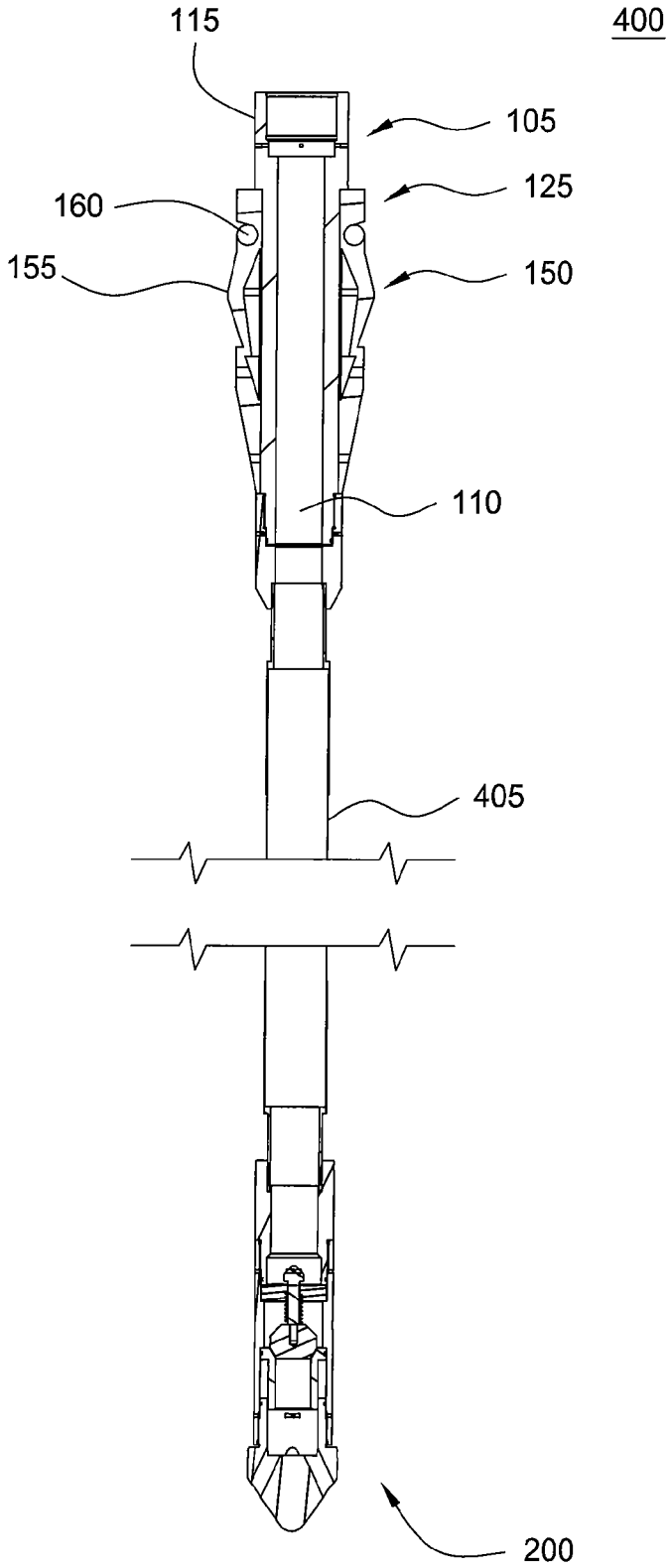
FIG. 7 is a view illustrating a fill-up and circulation tool according to another embodiment of the invention.

FIG. 7 is a view illustrating a fill-up and circulation tool 400 according to one embodiment of the invention. For convenience, the components in FIG. 7 that are similar to the components in FIG. 1 are labeled with the same reference indicator. Similar to the other embodiments, the tool 400 is used to fill a casing string with fluid and/or circulate fluid through the casing string. As illustrated in FIG. 7, one difference between the tool 400 and the tool 100 is that the tool 400 includes an extension tubular such as a mud hose 405 connected between the packer assembly 150 and the mudsaver valve assembly 200. Generally, the mud hose 405 is used as a flexible conduit as the tool 400 is inserted into the casing string. It should be noted that the mud hose 405 may have various lengths depending on the type of casing string.

Figure 8:
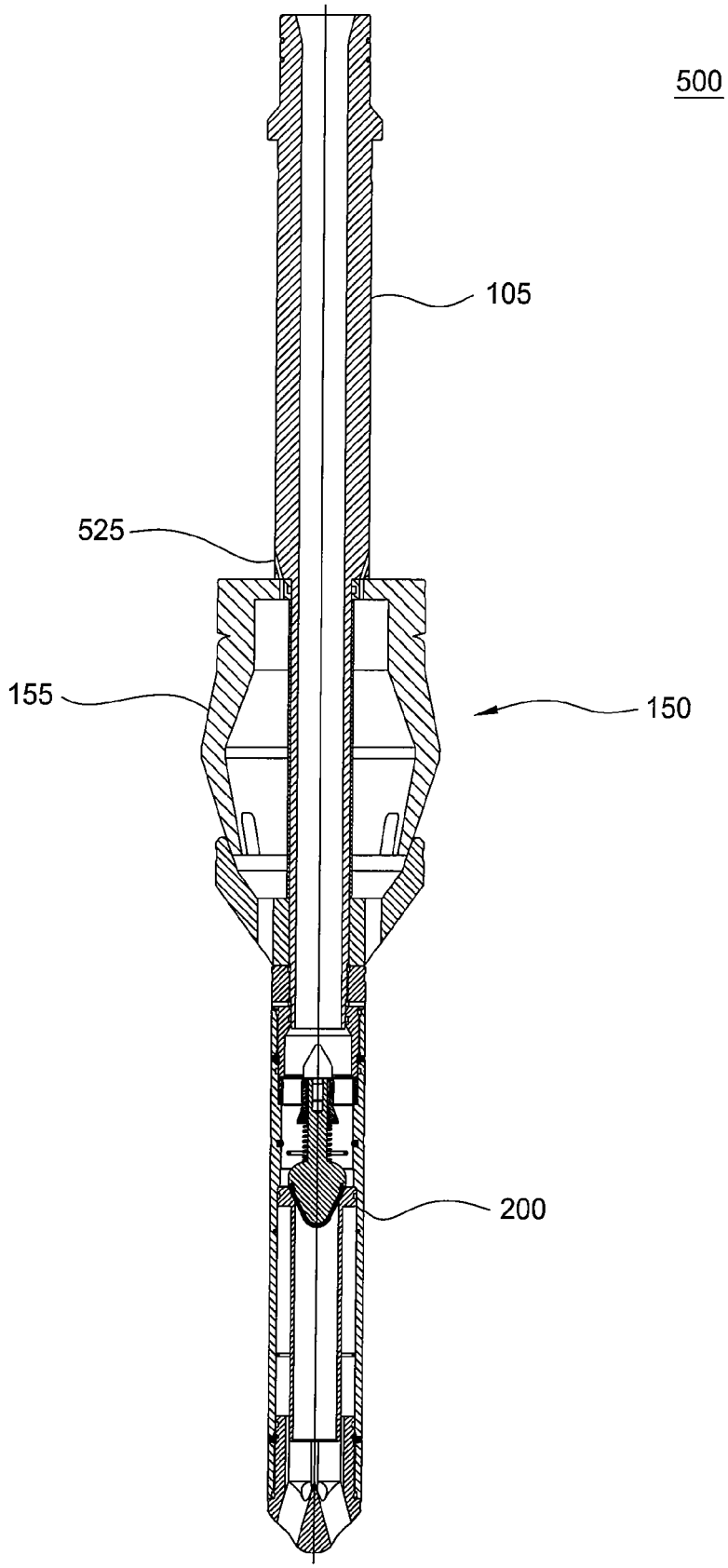
FIG. 8 is a view illustrating a fill-up and circulation tool according to another embodiment of the invention.

FIG. 8 shows another embodiment of a fill-up and circulation tool 500. For convenience, the components in FIG. 8 that are similar to the components in FIG. 1 are labeled with the same reference indicator. As shown, the tool 500 includes a mandrel 105, a packer assembly 150, a venting valve 525, and mudsaver valve assembly 200. In this embodiment, the venting valve 525 includes holes formed in the packer 155 and the mandrel 105. The holes in the mandrel 105 are open to the exterior of the mandrel 105 and are not in fluid communication with the bore of the mandrel 105. FIG. 8 shows the venting valve 525 in the open position, whereby the holes in the packer 155 are aligned with the holes in the mandrel 105. In the closed position, the holes in the mandrel 105 are not in alignment with the holes in the packer 155, thereby preventing pressure below the packer 155 from venting.

Figure 9:
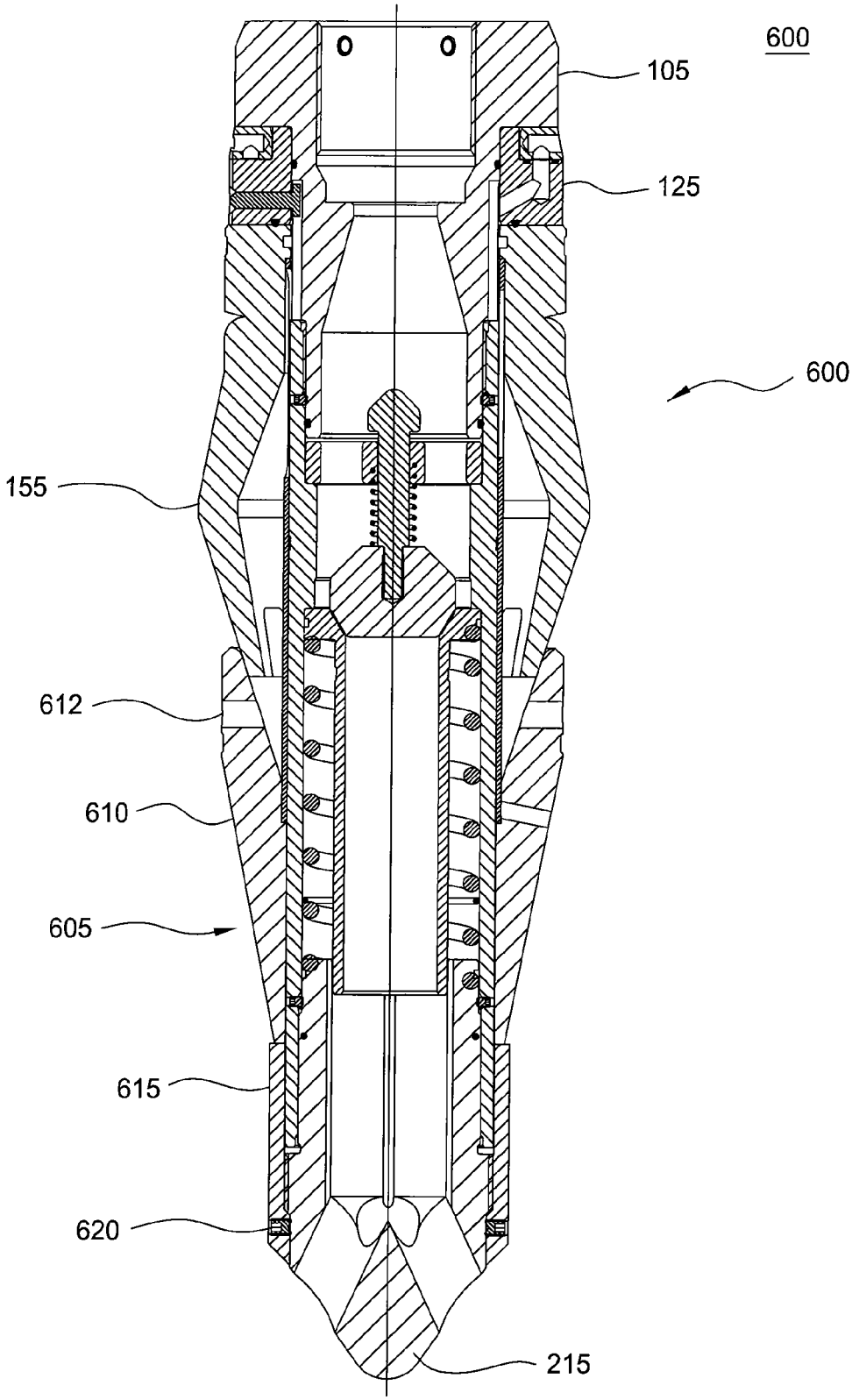
FIG. 9 is a view illustrating a fill-up and circulation tool according to another embodiment of the invention.

FIG. 9 shows another embodiment of a fill-up and circulation tool 600. For convenience, the components in FIG. 9 that are similar to the components in FIG. 1 are labeled with the same reference indicator. As shown, the tool 600 includes a mandrel 105, a venting valve 125, and mudsaver valve assembly 605. In this embodiment, the mudsaver valve assembly 605 includes a packer 155, a centralizer 610, and a retainer sleeve 615. The upper end of the centralizer 610 is surrounds the lower end of the packer 155. The centralizer 610 includes one or more ports 612 for fluid communication with the inner void of the packer 155. In another embodiment, the packer 155 and the centralizer 610 may be integrally formed. The retainer sleeve 615 has an inner diameter that is sufficiently sized for the retainer sleeve 615 to slide over the nose 215 of the tool 600. The retainer sleeve 615 may be retained on the tool 600 using one or more fasteners such as a screw 620. In addition or in the alternative, the retainer sleeve 615 may be threadedly connected to the outer surface of the tool 600.

The use of the retainer sleeve 615 facilitates the removal of the packer 155 from the tool 600. In use, the screws 620 may be release, thereby allowing the removal of the retainer sleeve 615. Thereafter, the centralizer 610 and the packer 155 may slide off of the bottom of the tool 600. In this respect, the packer 155 may be removed while the tool 600 is maintained in the closed position.

As discussed above, embodiments of the fill-up and circulation tool may be used with various tubular gripping tools. Exemplary gripping tools including external gripping tools and internal gripping tools are disclosed in U.S. patent application Ser. No. 12/435,346, filed on May 4, 2009 by M. Liess, et al., entitled "Tubular Handling Apparatus", which application is incorporated herein by reference in its entirety.

Figure 10:
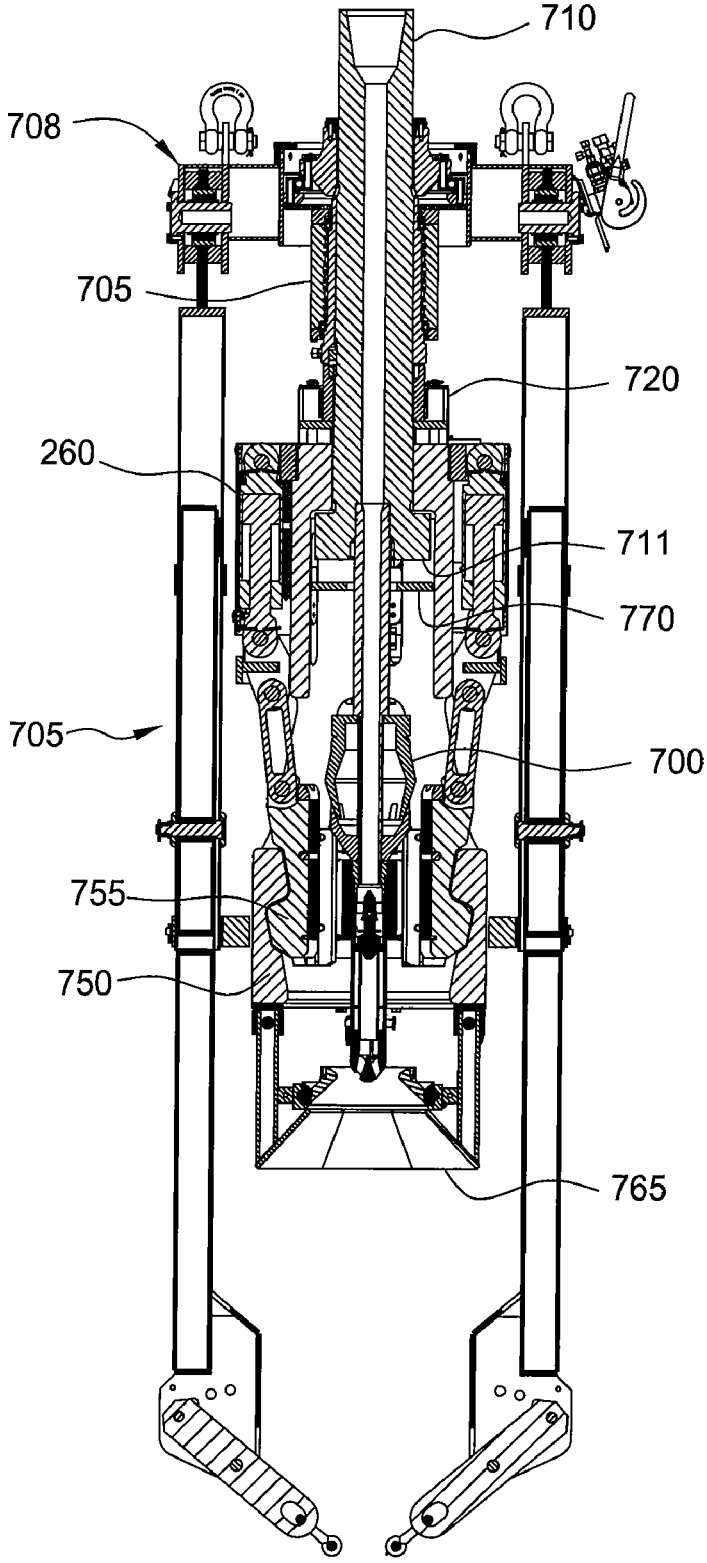
FIG. 10 shows a tubular gripping tool equipped with a fill-up and circulating tool according one embodiment of the invention.

FIG. 10 is a cross-sectional view of an exemplary external gripping tool 705 equipped with a fill-up and circulation tool 700. The external gripping tool 700 includes a mandrel 710 coupled to a carrier 750. The mandrel 710 has a load collar 711 which can engage an interior shoulder of the carrier 750. The mandrel 710 may have a polygonal cross-section such as a square for transferring torque to the carrier 750. The external gripping tool 700 also includes a plurality of gripping elements 755 and a hydraulic actuator 760 for actuating the gripping elements 755. The hydraulic actuator 760 may be attached to the carrier 750 using a threaded connection. In one embodiment, the gripping elements 755 are slips disposed in the carrier 750. Actuation of the hydraulic actuator 760 causes axial movement of the slips relative to the carrier 750. The gripping elements 755 have wedged shaped back surfaces that engage wedge shaped inner surfaces of the carrier 750. In this respect, axial movement of the gripping elements 755 relative to the wedge surfaces of the carrier 750 causes radial movement of the gripping elements. The gripping elements 755 may be detached from the actuator 760 and removed through a window of the carrier 750 or a lower end of the carrier 750. The lower end of the carrier 750 may include a guide cone 765 to facilitate insertion of the tubular. A tubular engagement plate 770 may be disposed in the carrier 750 for engagement with the upper end of the tubular. The external gripping tool may further include a thread compensator 720 to facilitate make up of the tubular and a swivel 705 for supplying fluid to the external gripping tool 700 for operation therof. A link tilt assembly 708 may be attached above the swivel to facilitate handling of the tubular. It must be noted that embodiments of the fill-up and circulation tool described herein may be used with an external or internal gripping tool. Additionally, the fill-up tool may be integrally formed on an internal tool.

Figure 11B:
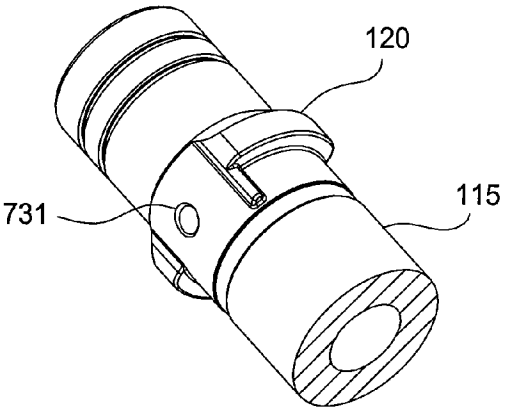
FIGS. 11A-11D show an embodiment of an attachment mechanism for attaching a fill-up and circulation tool to the a tubular gripping tool.
Figure 11B:
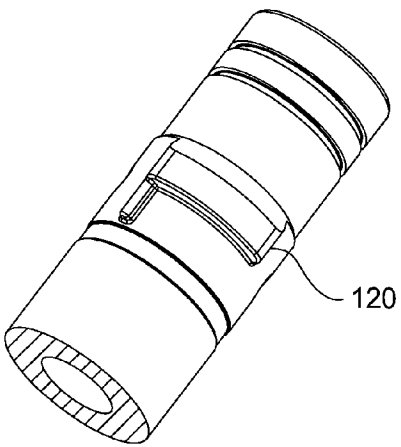
Figure 11A:
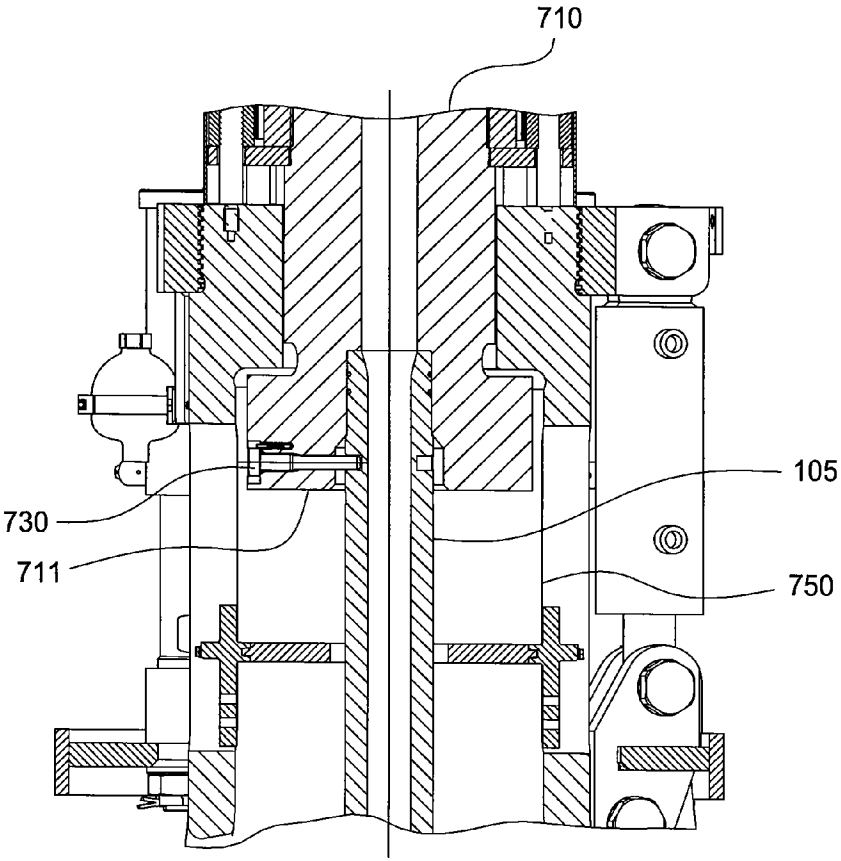
Figure 11D:
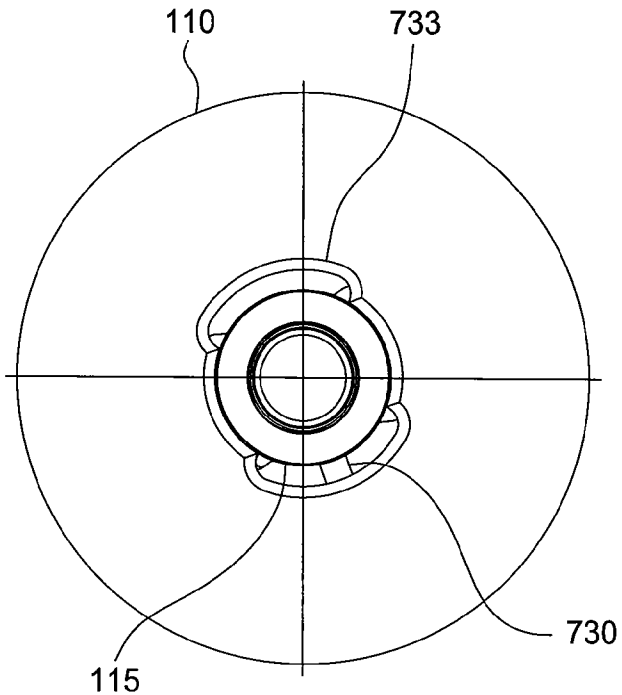
Figure 11C:
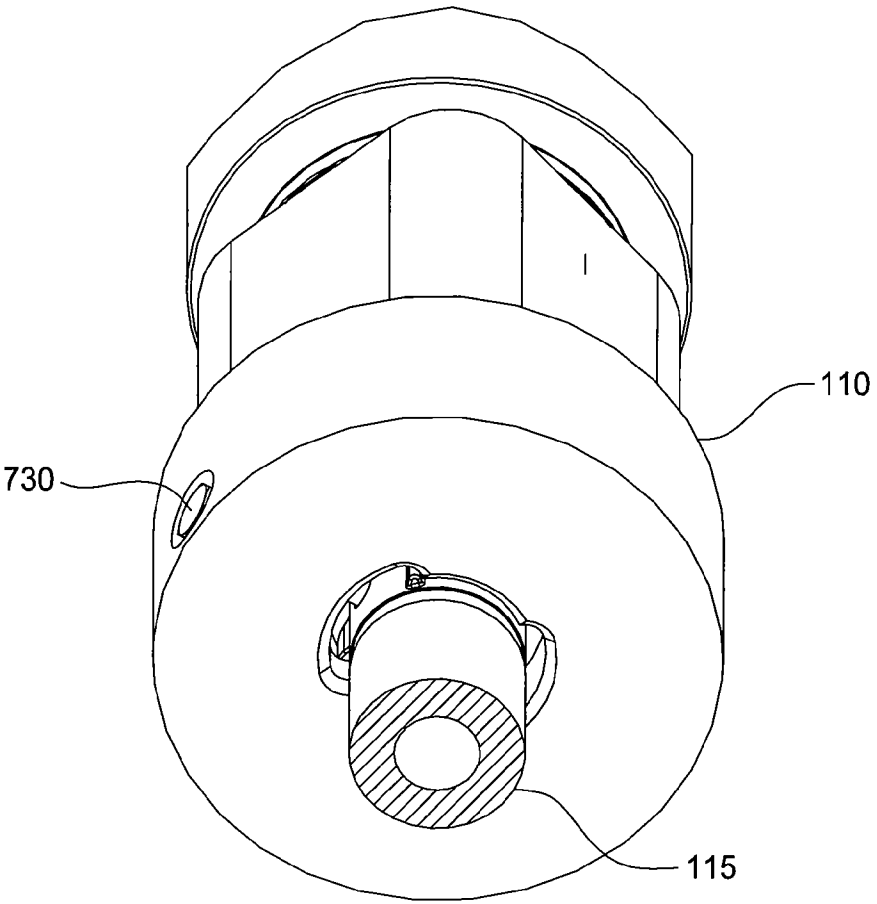

FIGS. 11A-11D illustrate one embodiment of attaching the fill-up tool 700 to the external gripping tool 705. FIG. 11A shows the upper portion 115 of the mandrel 105 of the fill-up tool 700 inserted into the mandrel 710 of the external tool 705. In one embodiment, the upper portion 115 is configured as a "bayonet mechanism" or a "bayonet-type coupling". Generally, a "bayonet mechanism" or a "bayonet coupling" means a connection involving a male end (i.e. upper portion 115) having at least one projection 120 in which the male end engages with a female end in the wellbore tool which has corresponding slots that mate with the at least one projection 120. A bayonet mechanism usually involves inserting the male end into the female end and then rotating the male end about a longitudinal axis of the tool 100 in order to lock or secure the connection between the male end and the female end. It is generally designed for rapid coupling and decoupling, involving the turning of one part through only a small arc, as compared to a screw-type arrangement, which requires several full turns. FIG. 11B shows an embodiment of the upper portion 115 of the mandrel 105 having a projection 120. As shows, two projections 120 are disposed on the upper portion 115. The upper portion also includes a hole 731 for retaining a pin 730. FIGS. 11C and 11D are views of the collar 711 after insertion of the fill-up tool 700. The opening in the collar 711 has two recesses 733 to allow the projections 120 to pass through the opening during insertion. After insertion, the upper portion 115 is rotated such that the projections 120 are offset from the recesses 733. Thereafter, a retainer 730 such as a pin may be inserted through the collar 711 and into the hole 731 of the upper portion 115. In another embodiment, the upper portion 115 includes a threaded portion that is configured to mate with a corresponding threaded portion in the external tool 705 in order to connection thereto. Further, in other embodiments, the upper portion 115 of the tool 100 may be connected to the wellbore tool by a J-slot, collet, latch, welding or any other suitable connection mechanism known in the art. Although the bayonet coupling is described with respect to the external gripping tool, it is contemplated that the bayonet coupling as well as other suitable connection mechanism discussed herein are equally suitable for use with an internal gripping tool.

In all embodiments, the vent valve is optional. Further, the vent valve may be operated manually or by remote actuation from a control panel.

In another embodiment, a fill-up and circulation tool includes a mandrel; a packer assembly is disposed around the mandrel; and a valve assembly connected to the mandrel. In another embodiment, the valve assembly includes a valve member biased in a first direction; and a valve seat member biased in a second direction, wherein the valve member is biased into engagement with the valve seat member to close fluid communication through the tool.

While the foregoing is directed to embodiments of the present invention, other and further embodiments of the invention may be devised without departing from the basic scope thereof, and the scope thereof is determined by the claims that follow.

The invention claimed is:

1. A fill-up and circulation tool, comprising:

a mandrel;

a packer assembly is disposed around the mandrel;

a vent valve disposed on the mandrel for venting a pressure in the packer assembly, wherein the vent valve is selectively moveable between an open position and a closed position, wherein the vent valve includes a hole in the packer assembly and a hole in the mandrel, and wherein the mandrel is rotatable relative to the packer assembly to align the hole of the mandrel to the hole of the packer assembly; and a valve assembly connected to the mandrel, wherein the valve assembly includes:

a valve member biased in a first direction; and a valve seat member biased in a second direction, wherein the valve member is biased into engagement with the valve seat member to close fluid communication through the tool.

2. The tool of claim 1, wherein fluid flow in the first direction will urge the valve seat member away from the valve member.

3. The tool of claim 1, wherein fluid flow in the second direction will urge the valve member away from the valve seat member.

4. The tool of claim 1, wherein fluid flow through the tool is blocked when the valve member and the valve seat member are engaged with each other.

5. The tool of claim 1, wherein the valve member comprises a valve head and the valve seat member comprises a tubular sleeve.

6. The tool of claim 1, wherein the packer assembly includes a packer member having an outer diameter larger than an inner diameter of a surrounding tubular.

7. The tool of claim 6, wherein the packer member includes a lower end having an outer diameter smaller than the outer diameter.

8. The tool of claim 1, wherein the packer assembly is disposed around the valve assembly.

9. The tool of claim 1, wherein the packer assembly is energizable by a fluid pressure below the packer assembly.

10. The tool of claim 1, wherein the vent valve includes an upper ring having a hole and a lower ring having a hole, wherein the upper ring is rotatable relative to the lower ring to align the hole of the upper ring to the hole of the lower ring.

11. The tool of claim 1, further comprising an extension tubular disposed between the packer assembly and the valve assembly.

12. The tool of claim 1, further comprising a retainer sleeve disposed on a lower portion of the valve assembly, wherein the retainer sleeve is adapted to retain a packing element of the packer assembly.

13. The tool of claim 1, further comprising a centralizer disposed around the mandrel.

14. The tool of claim 13, wherein the centralizer includes one or more ports for communicating fluid to an interior of the packer assembly.

15. A method of flowing fluid into or out of a tubular, comprising:

providing a flow control tool having a valve assembly comprising a valve member engaged with a valve seat member;

inserting the valve assembly into the tubular;

supplying fluid in a first direction to urge a valve seat member away from the valve member, thereby allowing fluid to flow into the tubular;

flowing fluid from the tubular in a second direction to urge the valve member away from engagement with the valve seat member, thereby allowing fluid to flow out of the tubular;

providing a packer assembly on the flow control tool and sealingly engaging the packer assembly with the tubular;

energizing the packer assembly using fluid pressure in the tubular; and venting the packer assembly prior to removing the flow control tool from the tubular.

16. The method of claim 15, further comprising rotating an upper ring of a vent valve into alignment with a lower ring of the vent valve, thereby aligning one or more holes of the vent valve to vent the packer assembly.

17. The method of claim 15, further comprising rotating a mandrel of the flow control tool into alignment with the packer assembly, thereby aligning one or more holes of the flow control tool to vent the packer assembly.

18. A fill-up and circulation tool, comprising:

a mandrel;

a packer assembly is disposed around the mandrel, wherein the packer assembly includes a packer member having an outer diameter larger than an inner diameter of a surrounding tubular, and wherein the packer member includes a lower end having an outer diameter smaller than the outer diameter; and a valve assembly connected to the mandrel, wherein the valve assembly includes:

a valve member biased in a first direction; and a valve seat member biased in a second direction, wherein the valve member is biased into engagement with the valve seat member to close fluid communication through the tool.

19. The tool of claim 18, further comprising a vent valve for venting a pressure in the packer assembly, wherein the vent valve includes an upper ring having a hole and a lower ring having a hole, wherein the upper ring is rotatable relative to the lower ring to align the hole of the upper ring to the hole of the lower ring.

20. The tool of claim 18, further comprising a vent valve for venting a pressure in the packer assembly, wherein the vent valve includes a hole in the packer assembly and a hole in the mandrel, wherein the mandrel is rotatable relative to the packer assembly to align the hole of the mandrel to the hole of the packer assembly.

21. A fill-up and circulation tool, comprising:

a mandrel;

a packer assembly is disposed around the mandrel; and a valve assembly connected to the mandrel, wherein the packer assembly is disposed around the valve assembly, and wherein the valve assembly includes:

a valve member biased in a first direction; and a valve seat member biased in a second direction, wherein the valve member is biased into engagement with the valve seat member to close fluid communication through the tool.

22. The tool of claim 21, further comprising a vent valve for venting a pressure in the packer assembly, wherein the vent valve includes an upper ring having a hole and a lower ring having a hole, wherein the upper ring is rotatable relative to the lower ring to align the hole of the upper ring to the hole of the lower ring.

23. The tool of claim 21, further comprising a vent valve for venting a pressure in the packer assembly, wherein the vent valve includes a hole in the packer assembly and a hole in the mandrel, wherein the mandrel is rotatable relative to the packer assembly to align the hole of the mandrel to the hole of the packer assembly.

24. A fill-up and circulation tool, comprising:

a mandrel;

a packer assembly is disposed around the mandrel;

a valve assembly connected to the mandrel, wherein the valve assembly includes:

a valve member biased in a first direction; and a valve seat member biased in a second direction, wherein the valve member is biased into engagement with the valve seat member to close fluid communication through the tool; and a retainer sleeve disposed on a lower portion of the valve assembly, wherein the retainer sleeve is adapted to retain a packing element of the packer assembly.

25. The tool of claim 24, further comprising a vent valve for venting a pressure in the packer assembly, wherein the vent valve includes an upper ring having a hole and a lower ring having a hole, wherein the upper ring is rotatable relative to the lower ring to align the hole of the upper ring to the hole of the lower ring.

26. The tool of claim 24, further comprising a vent valve for venting a pressure in the packer assembly, wherein the vent valve includes a hole in the packer assembly and a hole in the mandrel, wherein the mandrel is rotatable relative to the packer assembly to align the hole of the mandrel to the hole of the packer assembly.

27. A fill-up and circulation tool, comprising:

a mandrel;

a packer assembly is disposed around the mandrel;

a vent valve disposed on the mandrel for venting a pressure in the packer assembly; and a valve assembly connected to the mandrel, wherein the valve assembly includes:

a valve member biased in a first direction; and a valve seat member biased in a second direction, wherein the valve member is biased into engagement with the valve seat member to close fluid communication through the tool.

28. The tool of claim 27, wherein the vent valve is selectively moveable between an open position and a closed position.

29. The tool of claim 28, wherein the vent valve includes an upper ring having a hole and a lower ring having a hole, wherein the upper ring is rotatable relative to the lower ring to align the hole of the upper ring to the hole of the lower ring.

* * * * *